US005819873A

United States Patent [19]

Higgins

[11] Patent Number: 5,819,873

[45] Date of Patent: Oct. 13, 1998

[54] LADDER BRACKET AND LOCK

[76] Inventor: Ernest D. Higgins, 406 E. Windhorst, Brandon, Fla. 33510

[21] Appl. No.: 614,737

[22] Filed: Mar. 13, 1996

[51] Int. Cl.[6] ..... A47G 29/00

[52] U.S. Cl. ..... 182/129; 248/552

[58] Field of Search ..... 182/129, 127; 211/4; 248/552; 70/58

[56] References Cited

U.S. PATENT DOCUMENTS

| | | | |
|---|---|---|---|
| 426,655 | 4/1890 | Bennett | 248/552 |
| 754,483 | 3/1904 | Mustgrove | 248/552 |
| 3,507,398 | 4/1970 | Schaefer | 211/4 |
| 5,085,395 | 2/1992 | Frater | 248/552 |
| 5,524,772 | 6/1996 | Simmons | 211/4 |

FOREIGN PATENT DOCUMENTS

| | | | |
|---|---|---|---|
| 1125843 | 9/1968 | United Kingdom | 211/4 |
| 1173603 | 12/1969 | United Kingdom | 248/552 |

*Primary Examiner*—Alvin C. Chin-Shue
*Attorney, Agent, or Firm*—Stein, Schifino & Van Der Wall

[57] ABSTRACT

A ladder bracket for supporting and suspending a ladder therefrom adjacent a side wall of a structure wherein the ladder bracket is comprised of a back member having a first and second extension arm extending horizontally outward therefrom such that a lock plate is coupled to the distal ends of the extension arms to facilitate the securing and locking of the ladder to the ladder bracket. The lock plate is coupled to the second extension arm such that it pivots in a vertical plane to thereby provide access to the ladder bracket. The lock plate further providing for the use of a padlock thereon to secure the ladder bracket.

3 Claims, 2 Drawing Sheets

LADDER BRACKET AND LOCK

BACKGROUND OF THE INVENTION

1. Field of the Invention

This invention relates to a ladder bracket, and more particularly, to a lockable ladder bracket for supporting and securing a ladder to the side of a structure.

2. Description of the Background Art

Presently, many ladder brackets are commonly available in the industry today. However, the majority of the ladder brackets currently available are designed primarily for use on vehicles for supporting and carrying a ladder thereon. Thus, many of the current ladder brackets are only designed for temporary securement of a ladder whereupon, after the transporting of the ladder, via the vehicle to a specified location, the ladder is subsequently removed from the bracket. Additionally, many of the current ladder brackets do not provide for a long term securement of the ladder so to prevent an unauthorized use.

Representative ladder brackets that are commonly available today are disclosed in U.S. Pat. Nos. 1,959,611; 2,080,527; 2,237,853; 3,283,972; 3,904,094; 4,008,838; 4,390,117; 4,751,981; 5,118,156; 5,255,832; and 5,255,951, the disclosures of which are hereby incorporated by reference herein. Additionally, U.S. Pat. Nos. 5,165,501 and 5,215,163 are representative disclosures of ladder supports which aid the setting of a ladder against a house wherein the ladder cannot be set adjacent the roof edge. However, U.S. Pat. Nos. 5,165,501 and 5,215,163 do not disclose a ladder support directed to the supporting and securing of a ladder when not in use.

As can be seen from the references cited herein, the ladder brackets currently available today are of very complex designs directed toward vehicle installations that require a long time to assemble and install. Further, being of very complex designs, the prior art ladder brackets are expensive to manufacture and lend themselves to very little versatility regarding installation.

Representative of ladder brackets used for the securing of ladders to the side of a structure, such as a building, is U.S. Pat. No. 3,800,959, issued to Finocchiaro, et al., the disclosure of which is hereby incorporated by reference herein. However, the ladder holder of Finocchiaro does not serve to support and store a ladder up out of the way such as in the present invention. Further, Finocchiaro teaches only a means for securing a ladder to the side of a building which is standing upright and leaning against the building while in contact with the ground. Finocchiaro discloses primarily a bar type lock for ladders comprised of an elongated member extending outward from the wall of a structure wherein a cross bar member having a sleeve coupled thereto slides along the elongated member such that the cross bar encompasses the rails of a ladder to thereby trap the ladder between the cross bar and the wall. Finocchiaro does not teach a ladder bracket for supporting and hanging a ladder thereon adjacent a wall of a structure.

Therefore, it is an object of this invention to provide an improvement which overcomes the aforementioned inadequacies of the prior art devices and provides an improvement which is a significant contribution to the advancement of the ladder bracket art.

Another object of this invention is to provide a ladder bracket designed for use on structures to facilitate the supporting and hanging of ladders on a wall of the structure.

Another object of this invention is to provide a ladder bracket having the ability to support and hang a ladder therefrom such that the ladder is locked and secured to the structure so to prevent any theft thereof.

Another object of this invention is to provide a ladder bracket having an efficient design which is easy to manufacture and use. The ladder bracket of the present invention thereby requiring no assembly by the user in that it is comprised of only two separate parts which are pivotally coupled to each other.

Another object of this invention is to provide a ladder bracket having a design which is versatile and can be easily installed in various places wherein only a relatively flat surface is required.

Another object of this invention is to provide a ladder bracket that is made from steel plate so to provide adequate support for various sized ladders and is, hence, difficult to cut through or break if a theft of the ladder is attempted.

Another object of this invention is to provide a ladder bracket for supporting and holding a ladder adjacent a structure, the ladder having a pair of rails and a plurality of rungs positioned therebetween, the ladder bracket comprising in combination: a back member having one end and an opposite end; a first extension arm coupled to the back member intermediate to the one end and the opposite end, the first extension arm further having an underside; a second extension arm coupled to the back member intermediate to the opposite end and the first extension arm; and a lock plate pivotally coupled to the second extension arm, wherein the lock plate pivots in a vertical plane to align with the first extension arm thereby facilitating the placement of a pad lock through the lock plate and the first extension arm, whereby the back member is secured to the structure and the ladder is positioned on and supported by the first extension arm such that the first and second extension arms, the back member and the lock plate cooperate to capture at least one of the rails of the ladder therein thereby locking the ladder in position.

The foregoing has outlined some of the pertinent objects of the invention. These objects should be construed to merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention comprises a ladder bracket having a back member that is secured to the wall of a structure wherein a first extension arm and a second extension arm, each having distal ends, extend outward horizontally from the back member such that a lock plate is coupled to both distal ends of the arms. Thus, the lock plate serves to enclose at least one rail of a ladder of which the first extension arm extends through.

The distal ends of the first and second extension arms include a first and second end flange having a respective first and second hole therein. The lock plate is designed so to include a third and fourth hole which correspondingly cooperate with the first and second holes to receive a pin and a padlock therethrough to facilitate locking the ladder bracket. Further, the ladder bracket includes a bracing member which is coupled to the underside of the first extension arm and the back member so as to provide added support to the first extension arm upon which the ladder suspends therefrom.

Additionally, the lock plate is pivotally coupled at an end to the second extension arm such that the lock plate pivots in a vertical plane to provide access to the ladder bracket for positioning a ladder within or removing a ladder therefrom.

An important feature of the present invention is that the ladder bracket provides the ability to lock and secure a ladder being supported and suspended to the side wall of a structure.

Another important feature of the present invention is that the ladder bracket is of a versatile design which can be easily installed in various places requiring only a relatively flat surface to be mounted on.

Another important feature of the present invention is that the ladder bracket is formed from steel plate which provides strength for supporting a ladder and is difficult to cut or break should theft be attempted.

Therefore, it can be readily appreciated that the present invention overcomes the inadequacies in the prior art ladder brackets in use today and provides a long sought-after solution in the ladder bracket art.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the invention, reference should be directed to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
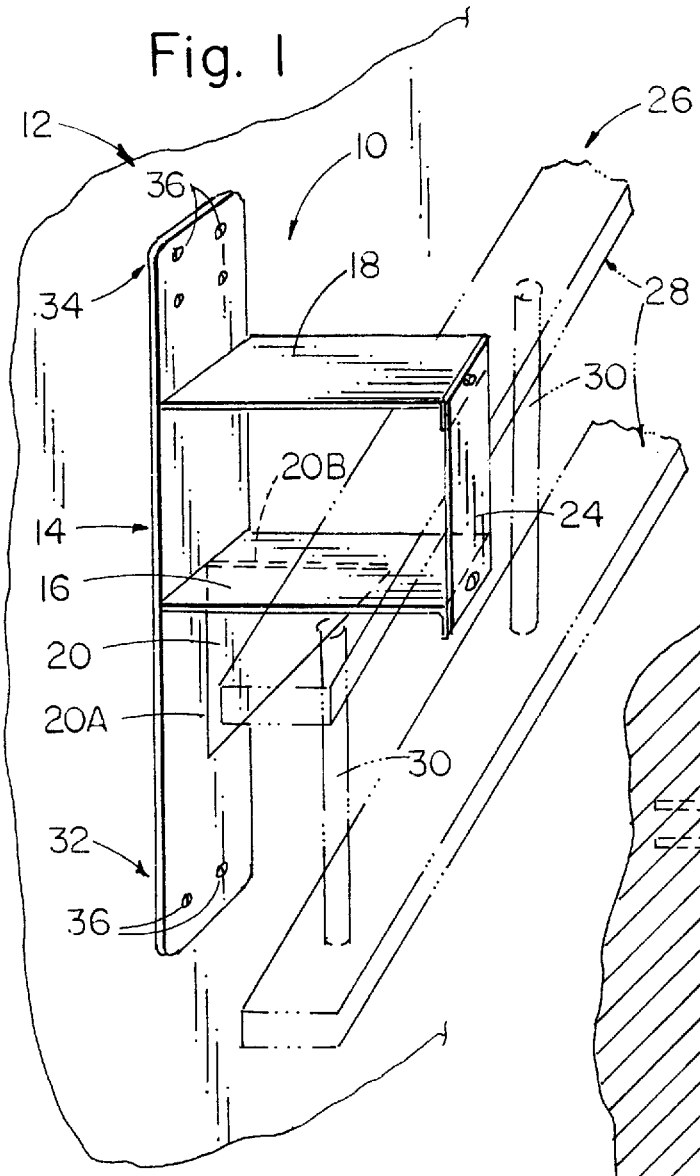
FIG. 1 is a perspective view of the ladder bracket in an installed position on the side wall of a structure illustrating the back member, the first extension arm, the second extension arm, the lock plate and the bracing member in their relative positions to each other.

In referring to FIG. 1, a perspective view of the ladder bracket 10 can be seen as installed adjacent a structure 12. The ladder bracket 10 is comprised primarily of a back member 14, a first extension arm 16, a second extension arm 18, a bracing member 20, a pin 22 and a lock plate 24. The ladder bracket 10 is shown with a ladder 26 in its supported position (ladder 26 is depicted in partial phantom). The ladder 26 is comprised of a pair of rails 28 and a plurality of rungs 30 positioned therebetween.

The back member 14 is elongated in shape having one end 32 and an opposite end 34. The back member 14 is preferably formed from steel plate of sufficient thickness suitable for supporting the weight of the ladder 26. The back member 14 is preferably secured to the structure 12 by way of inserting bolts 35 through a plurality of securing holes 36 positioned adjacent the one end 32 and the opposite end 34 into the structure 12 (see FIG. 2). The bolts 35 used for securing the back member 14 to the structure 12 are preferably standard bolts commonly available in the industry for penetrating cement or the like as dictated by the material make-up of the structure 12.

Figure 2:
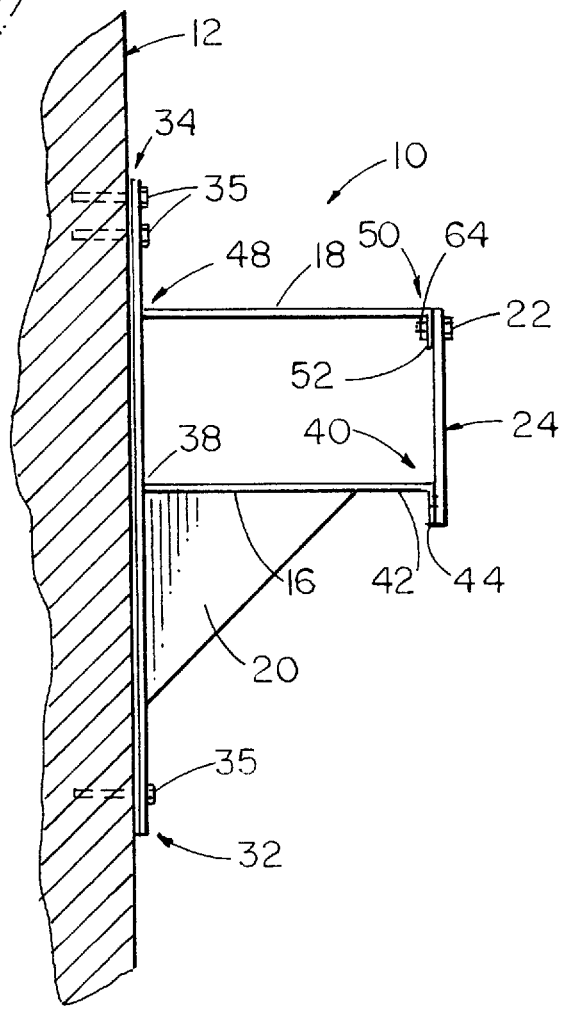
FIG. 2 is a side elevational view of the ladder bracket in an installed position on a wall of a structure illustrating the lock plate, the pin, the bracing member, and the first and second extension arms in their relative positions to each other.

In referring now to FIG. 2, the ladder bracket 10 can be seen in a side elevational view as installed on the structure 12. The first extension arm 16 is shown to extend horizontally outward from the back member 14 and includes a first proximal end 38, a first distal end 40, an underside 42 and a first end flange 44. The first proximal end 38 of the first extension arm 16 is coupled to the back member 14 intermediate to the one end 32 and the opposite end 34. The first end flange 44 is coupled to the first distal end 40 of the first extension arm 16. The first extension arm 16 is preferably coupled to the back member 14 by way of conventional welding techniques commonly used in industry. The first end flange 44 is preferably integral with the first distal end 40 of the first extension arm 16. The first end flange 44 can be seen to further include a first hole 46 positioned therethrough.

Similarly, the second extension arm 18 can be seen to be coupled to the back member 14 and extending horizontally outward therefrom. The second extension arm 18 includes a second proximal end 48, a second distal end 50 and a second end flange 52. The second proximal end 48 of the second extension arm 16 is coupled to the back member 14 intermediate to the opposite end 34 and the first extension arm 16. The second proximal end 48 of the second extension arm 18 is preferably coupled to the back member 14 by way of conventional welding techniques commonly used in industry. The second end flange 52 is preferably integral with the second distal end 50 of the second extension arm 18. Further, the second end flange 52 can be seen to include a second hole 54 extending therethrough.

Figure 3:
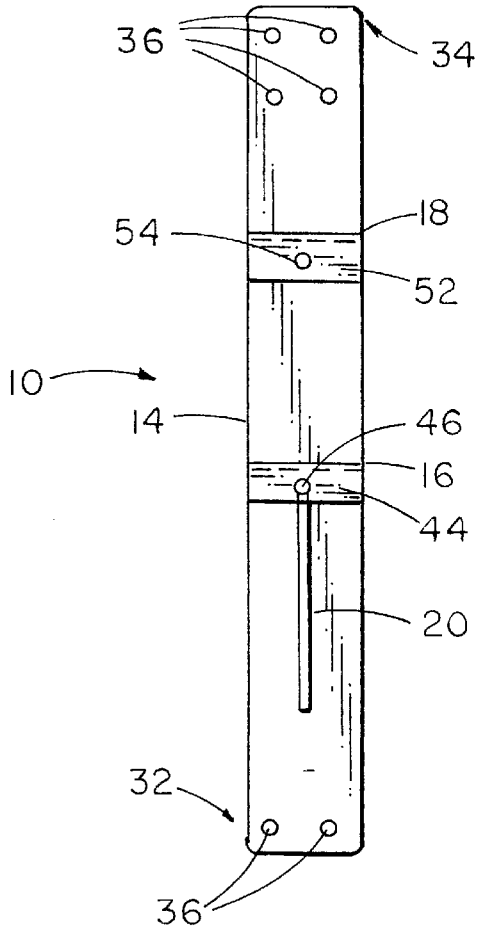
FIG. 3 is a front elevational view of the ladder bracket illustrating the first and second end flanges positioned at the distal end of the respective first and second extension arms as well as the bracing member in their relative positions to each other.

In referring now to FIGS. 1, 2 and 3, the bracing member 20 can be readily seen in position supporting the first extension arm 16. The bracing member 20 is coupled along one side edge 20A to the back member 14 and along an upper side edge 20B coupled to the underside 42 of the first extension arm 16. The bracing member 20 can be seen to be coupled to the back member 14 and the first extension arm 16 along their respective center lines (see FIG. 3).

Figure 4:
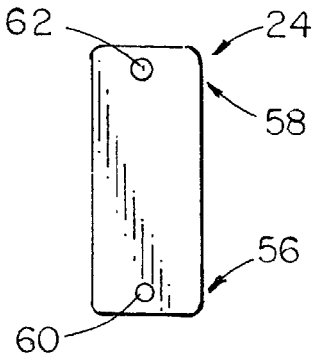
FIG. 4 is a plan view of the lock plate illustrating the locking end, the other end and the third and fourth holes in their relative positions to each other.

In referring now to FIG. 4, a plan view of the lock plate 24 can be seen illustrating the third and fourth holes 60 and 62 positioned adjacent the respective locking end 56 and other end 58. The lock plate 24 is preferably formed of steel plate suitable for securing the ladder bracket 10 in a manner that resists breakage or being cut in the event of an attempted theft of the ladder.

In referring now back to FIG. 2, the coupling of the lock plate 24 to the second end flange 52 of the second extension arm 18 may be readily understood. The lock plate 24 is coupled to the second end flange 52 by way of a threaded pin 22 being inserted through the fourth hole 62 in the other end 58 of the lock plate 24 and through the second hole 54 in the second end flange 52 wherein a nut 64 is threadedly engaged with the threaded pin 22. The nut 64 is threadingly engaged with the threaded pin 22 only to the extent so as to allow the lock plate 24 to pivot about the threaded pin 22 in a vertical plane. Once the nut 64 is threadedly engaged with the threaded pin 22 to the extent necessary to allow a pivoting of the lock plate 24, the nut 64 is permanently welded to the threaded pin 22 so as to prevent any possible disengagement.

Figure 5:
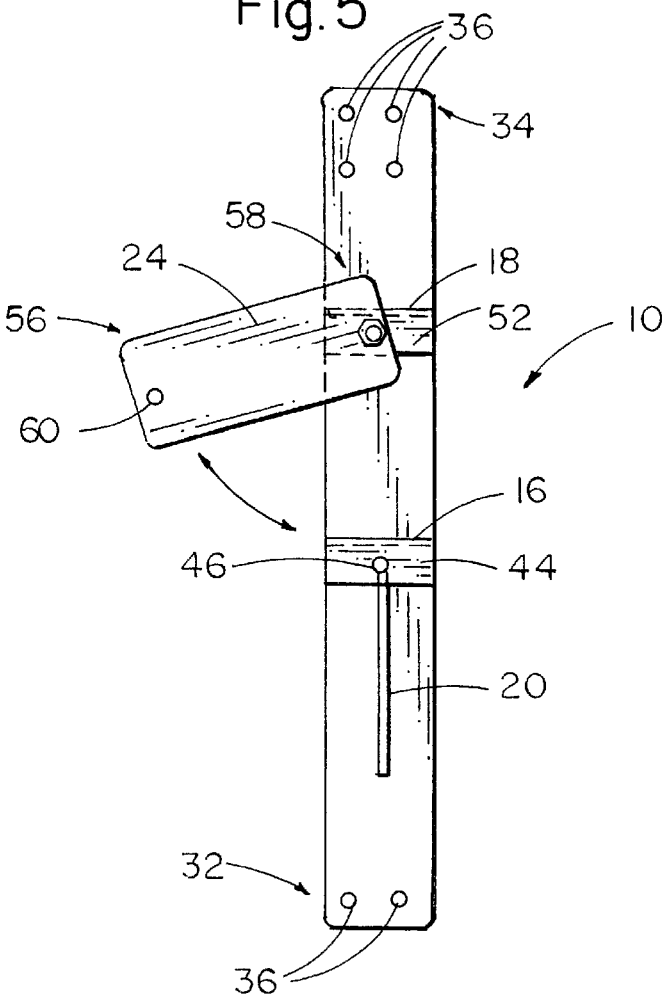
FIG. 5 is a front elevational view of the ladder bracket illustrating the lock plate in position having been pivoted in the vertical plane so to provide access to the ladder bracket.

In now referring to FIG. 5, the ladder bracket 10 can be seen in a front elevational view illustrating the lock plate 24 in a position after the lock plate 24 has been pivoted in the vertical plane with the lock plate 24 in an upward pivoted position as in FIG. 5, access to the ladder bracket 10 is obtained to facilitate placing a ladder 26 within or removing a ladder 26 therefrom.

Now that the structure of the present invention has been described in detail, the operation can be readily understood. Once the ladder bracket 10 is installed on a structure 12 via bolts as depicted in FIG. 2, the lock plate 24 is pivoted in the vertical plane so as to allow the ladder 26 to be placed upon the first extension arm 16 wherein at least one of the rails 28 of the ladder 26 is rested on top of the first extension arm 16. After placement of the ladder 26 in the ladder bracket 10, the lock plate 24 is then pivoted downward in the vertical plane so as to cooperatively align the third hole 60 in the locking end 56 of the lock plate 24 with the first hole 46 in the first end flange 44. Once the lock plate 24 has been pivoted downward, aligning the third hole 60 with the first hole 46, a padlock may then be inserted through the holes 60 and 46 and locked to thereby secure the ladder 26 within the ladder bracket 10. It is preferable that the ladder bracket 10 is used on conjunction with an additional ladder bracket such that each ladder bracket 10 is positioned near the ends of the ladder 26. Although it is preferable to use a pair of ladder brackets 10, it is possible to use a single ladder bracket 10 to support and suspend a ladder 26 therefrom.

In order to remove the ladder 26 from the ladder bracket 10, the padlock (not shown) is unlocked and removed from the third and first holes 60 and 46 and the lock plate 24 is pivoted upwards in the vertical plane to provide access to the ladder 26. It is preferable that the thread pin 22 and nut 64 are engaged to the extent that the lock plate 24 remains in its pivoted position until forcibly pivoted back into alignment with the first end flange 44 of the first extension arm 16. When positioning the ladder 26 in the ladder bracket 10, the first extension arm 16 is to pass between the rails 28 and between the rungs 30 of the ladder 26 such that the first extension arm 16, the second extension arm 18, the back member 14 and the lock plate 24 cooperate to encompass at least one of the rails 28 of the ladder 26.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A ladder bracket for supporting and holding a ladder in a position adjacent a structure, the ladder having a pair of rails and a plurality of rungs positioned therebetween, said ladder bracket comprising in combination:

a back member having one end and an opposite end;

a first extension arm having a first proximal end, a first distal end and an underside, said first proximal end being coupled to said back member intermediate to said one end and said opposite end; and a locking means for releasably locking the ladder to said ladder bracket, said locking means being coupled to said first extension arm, said locking means including a second extension arm and a lock plate, said second extension arm having a second distal end and a second proximal end, said second proximal end being coupled to said back member intermediate to said opposite end and said first extension arm, said lock plate having a locking end and an other end, said other end being pivotally coupled to said second distal end and said locking end being releasably coupled to said first distal end of said first extension arm; said first and second distal ends of said first and second extension arms further including respective first and second end flanges coupled thereto with respective first and second holes and with said second end flange being oriented in a direction toward said first extension arm, said lock plate further including a third hole positioned adjacent said locking end and a fourth hole positioned adjacent said other end, said third and fourth holes thereby cooperatively aligning with said respective first and second holes of said first and second end flanges, said second and fourth holes receiving a pin therethrough facilitating pivotal movement of said lock plate thereabout in a vertical plane, and said first and third holes accommodating the placement of a shank of a padlock therethrough;

whereby said back member may be secured to the structure and the ladder may be positioned on and supported by said first extension arm such that said locking means may be operated to releasably lock the ladder in position to prevent unauthorized use thereof.

2. The ladder bracket as recited in claim 1, wherein said ladder bracket further includes a bracing member positioned between and coupled to said underside of said first extension arm and said back member adjacent said one end.

3. The ladder bracket as recited in claim 1, wherein said back member further includes a plurality of securing holes positioned adjacent said one end and said opposite end.

* * * * *